United States Patent [19]

Gomolka

[11] 4,192,567

[45] Mar. 11, 1980

[54] ELECTRICAL CONNECTOR

[76] Inventor: William Gomolka, 1 Patriots Dr., Canton, Mass. 02021

[21] Appl. No.: 903,410

[22] Filed: May 8, 1978

[51] Int. Cl.[2] ..... H01R 7/28; H01R 9/12; H01R 13/62

[52] U.S. Cl. ..... 339/75 M; 339/253 S; 339/256 S

[58] Field of Search ..... 339/74 R, 75 R, 75 M, 339/256 S, 256 RT, 75 T, 61 L, 55, 253 R, 253 S, 252 R, 252 S, 268 R, 268 S

[56] References Cited

U.S. PATENT DOCUMENTS 3,170,753 2/1965 Witte et al. ..... 339/256 S

OTHER PUBLICATIONS

Pluggable Wire Wrapping Connector, Kennedy et al., IBM Technical Disclosure Bulletin, vol. 6, No. 1, pp. 36–37, 6–1963.

*Primary Examiner*—Eugene F. Desmond
*Attorney, Agent, or Firm*—Wolf, Greenfield & Sacks

[57] ABSTRACT

The connector of this invention comprises a male connector part and a female connector part. The male connector part comprises a plurality of prongs. The male prongs are adapted for effortless insertion with substantially no force required for insertion into the female receptacle with the connector parts, after insertion being lockable into an electrically tight condition. The male prong construction may be in the form of a cylindrical rod or any other shape such as a ribbed configuration. The female receptacle is formed by a coil spring having each coil of the spring adapted to squeeze the male probe providing, as the connector parts are locked, self-wiping action during the quick locking procedure. This self-wiping action cleans the mating parts of the electrical connector.

23 Claims, 14 Drawing Figures

Fig. 11
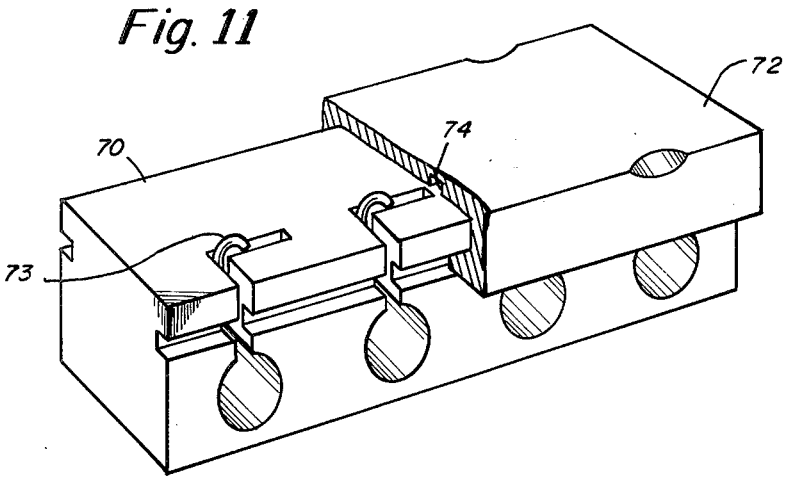
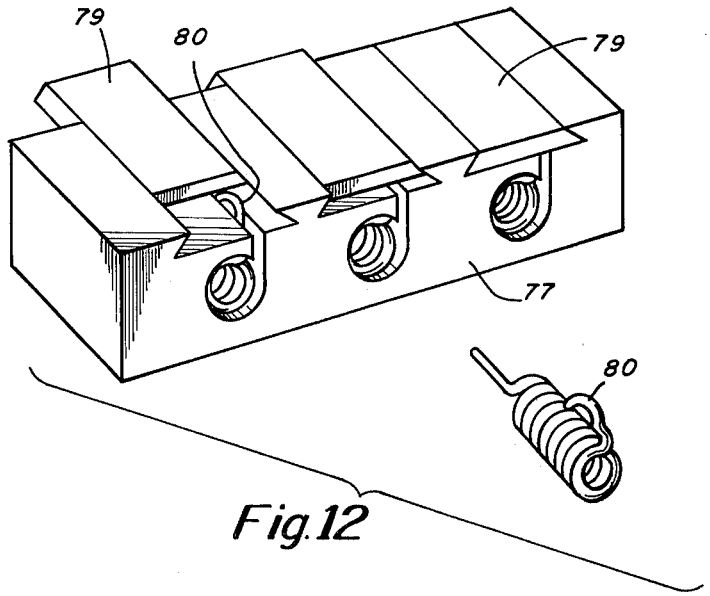
Fig. 12
Fig. 13
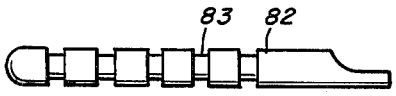
Fig. 14
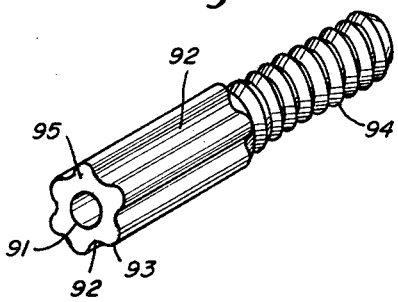

ELECTRICAL CONNECTOR

BACKGROUND OF THE INVENTION

The present invention relates to electrical coupling devices commonly referred to as electrical connectors. The connector is typically used to interconnect wires, cables or other conductors and in accordance with the present invention the connector provides essentially friction-free insertion of a male member into the female receptacle.

In many connector constructions, especially those used with multiple-wire cables, a considerable force is usually necessary in order to mate the two connector parts. In accordance with this invention the male pins or prongs are capable of being engaged in the female receptacles with substantially no physical resistance from the receptacles during the insertion operation. An automatic wiping action between the individual receptacles and pins occur providing a means of cleaning the mating parts to remove, for example, undesirable films or impurities which may be on the parts. This assures essentially perfect electrical connection. Also, this self-wiping action occurs during the quick locking process of the male connector with the female connector.

Since, in accordance with the invention the insertion of the male connector into the female receptacles does not require any substantial force and because the locking process also requires practically no force, the electrical connector can then be constructed with a great number of pins and receptacles without having any problem as to the mating of the male and female parts.

Accordingly, it is an object of the present invention to provide a reliable coupling between two objects which are typically connector parts, one of which is a female connector having receptacles and the other of which is a male connector having pins or probes and to further provide a means of quick engagement and disengagement between the mating parts.

Another object of the present invention is to provide an individual receptacle that is actually comprised of many receptacle coils for squeezing radially the male pin each independently from the other and yet forming one integral receptacle made from an integral piece of material, which in accordance with the present invention is preferably a coil spring arrangement.

Still another object of the present invention is to provide a connector that is constructed so as to enable the use of a great number of contacts between the receptacle and inserted object.

Another object of the present invention is to provide a complete friction-free connector allowing little or no friction upon insertion of the male pins into the female receptacles.

A further object of the present invention is to provide a reliable connector and in particular a reliable female receptacle which essentially is constructed with an inherent redundancy primarily to the use of the many receptacle portions which in all embodiments are the individual coils comprising the coil spring.

Another object of the present invention is to provide an electrical connector which is easily adapted to miniaturization and capable of withstanding severe mechanical strains, stresses, vibrations and shocks essentially from any direction without harmful effects on the coupling performance of the connector.

Still another object of the present invention is to provide an electrical connector in which the electrically matable parts, when engaged and locked, form a continuous electrical connection as well as a good mechanical joint over a substantial are with a positive individual radial pressure exerted by each receptacle portion (coil of spring) to maintain the two parts firmly together.

A further object of the present invention is to provide a connector that is operated so as to decrease the wear of the plating on the inside diameter of the receptacle and on the outside diameter of the pin which usually occurs by repeated frequent insertions and withdrawals. In accordance with the invention, the wear is quite negligible, and yet the plating surface is maintained at a sufficient thickness so as to assure a reliable connection.

Another object of the present invention is to provide a connector having a uniform plating on the inside diameter of the receptacle.

Another object of the present invention is to provide an electrical connector that is readily adapted to the use of more than one pin to be inserted in the same receptacle at the same time.

A further object of the present invention is to provide an electrical connector that is adapted to carry substantially large amounts of current in comparison to its size and weight.

Still another object of the present invention is to provide an electrical connector where the male connector, when unlocked, can be removed from the female connector without any substantial force.

Another object of the present invention is to provide an improved female connector, comprised of a coil spring, with each coil of the spring acting upon the male connector part individually and all coils acting simultaneously when the parts are mated.

Another object of the present invention is to provide a connector that is characterized by a wiping action between the receptacle and pin. This wiping action occurs even though there is a friction-free connection when the connector parts are initially mated.

Another object of the present invention is to provide a connector wherein the receptacles can accept any shape of male pin including a round, rectangular or triangular pin or even a screw pin and without suffering any harmful effects of contact quality.

Yet another object of the present invention is to provide an electrical connector having the ability of carrying very low level signals and very low current signals.

Still a further object of the present invention is to provide an electrical connector having the ability of carrying signals without adding any noise to these signals that are coupled to the connector.

Still another object of the present invention is to provide an electrical connector where the contact resistance between the receptacle and pin is in a low resistance magnitude of micro ohms.

Still another object of the present invention is to provide a connector with a stable contact resistance regardless of the number of insertions and withdrawals of the connector parts.

Another object of the present invention is to provide an electrical connector that eliminates alignment problems between the female and male connector parts.

Yet another object of the present invention is to provide an electrical connector wherein temperature changes do not effect the stable contact resistance of the connector.

Still another object of the present invention is to provide a connector wherein pressure of each individual coil of the female receptacle provides for an even distribution of pressure between the connector parts along the whole male connector pin.

Another object of the present invention is to provide an explosion proof electrical connector.

Still another object of the present invention is to provide an electrical connector which can maintain the stable current flow through the connector even when the connector is subjected to severe vibrations and shocks from substantially any direction.

Another object of the present invention is to provide a connector having locking means associated with the connector for providing an extremely tight contact between the receptacle and inserted object after they have been easily inserted.

Yet another object of the present invention is to provide a connector pin in the form of a screw.

Another object of the present invention is to provide a connector pin having a locking means associated therewith.

Another object of the present invention is to provide an electrical connector with a gas-tight contact.

Still another object of the present invention is to provide an electrical connector which can withstand enormous amounts of insertions and withdrawals with no harmful effects on the proper connection quality.

SUMMARY OF THE INVENTION

To accomplish the foregoing and other objects of this invention there is provided an electrical connector which comprises a male connector part and a female connector part. The male connector part includes a plurality of elongated prongs, each of which, in one embodiment, comprises an elongated cylindrical prong or pin. The female connector part comprises a housing which is made of an electrically insulated material having a number of bores corresponding to the number of pins in the male connector. Each of these bores is for accommodating a female receptacle which, in one embodiment comprises a coiled compression spring. The coiled compression spring is open at one end to receive the pin and has its other end terminating from the female connector part housing to permit connection of electrical wiring thereto. In one embodiment the female connector part also includes a retaining plate operated by a movable shell of the connector to compress and permit expansion of the coiled compression spring receptacle. This retaining plate maintains the receptacle in its compressed position wherein the inner diameter of the receptacle is at its maximum diameter so as to permit easy insertion of the male pins into the female receptacle. Once inserted, the retaining plate may then be moved to permit expansion of the coiled compression spring so that the spring can tighten about the male connector pin. During this tightening sequence wiping action also occurs between the pin and receptacle as the receptacle firmly tightens about its associated pin.

In another embodiment of the present invention the female receptacle is comprised of a torsion spring having one end engaged by a locking ring so that as the locking ring is tightened, the torsion spring has its inside diameter reduced so as to firmly grasp the previously inserted male pin. In still other embodiments of the invention the female receptacle may be constructed of a coiled compression spring adapted to receive mating male connector pins inserted at opposite ends thereof. The male connector pins may also be in different constructions such as a ribbed pin or a pin having associated therewith a locking means.

DESCRIPTION OF THE DRAWINGS

Numerous other objects, features and advantages of the invention should now become apparent upon a reading of the following detailed description taken in conjunction with the accompanying drawings, in which:

FIG. 11 is a perspective view partially cut away and showing a rectangular connector block employing the principles shown in the connector of FIG. 9;

FIG. 12 is another perspective view of a rectangular connector block which may employ the connector of FIG. 9 but with a different principle of locking;

FIG. 13 shows a male connector pin with separated grooves; and

FIG. 14 is still another embodiment of a male connector pin with axial grooves and a threaded end.

DETAILED DESCRIPTION

Figure 1:
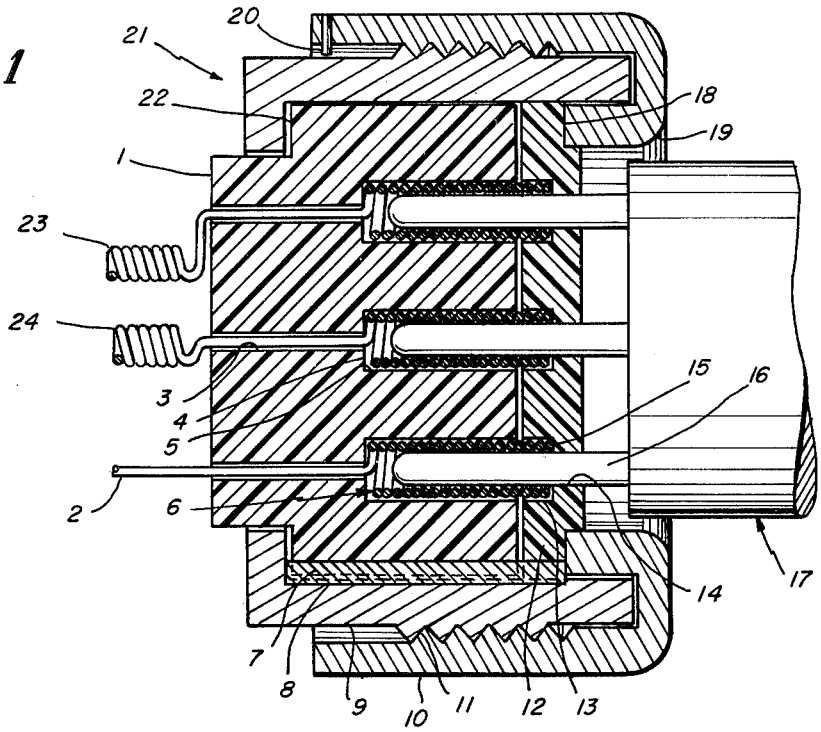
FIG. 1 is a cross-sectional view of an electrical connector constructed in accordance with the present invention and that may be of round construction.

Referring now to FIG. 1, there is shown an electrical connector in accordance with the invention comprising a male connector part 17 and a female connector part 21. The male connector part has a plurality of pins 16 extending therefrom. The male connector part is not shown in cross-section but the female connector part is shown in a cross-sectional illustration. The female connector part 21 comprises a housing 1, which is preferably made from an electrically insulated material and has one or more bores 5 terminating at one end with the bottom wall 4. An aperture 3 also extends from the bore 5 for receiving an end 2 of the complete receptacle 6. The receptacle 6 in the embodiment of FIG. 1 comprises a coiled compression spring.

The shell 9 has a groove 8 for receiving a key 7 which prevents rotation between the shell and housing. The other portion of key 7 is located in a groove in the housing 1 and also a groove provided in the retaining plate 12. Both the housing 1 and the retaining plate 12 are enclosed in shell 9 and are restrained by a shoulder 22 and a shoulder 19 of the threaded ring 10 which has threads indicated at 11. The retaining plate 12 is also made from an electrically insulated material and has one or more bores 13 and also corresponding apertures 14. Bores 13 terminate in a bottom wall 15. The male pin 16 is shown in FIG. 1 inserted with ease into the receptacle 6. In order to receive the shoulder 19 the retaining plate may be provided with a shoulder 18. The receptacles 6 may also be terminated at their outer end in the form of a compression, extension or torsion spring 23, 24 so as to accept external connections to the connector.

In a slightly different embodiment of the invention, instead of using the locking ring 10 there can be provided an electrically controlled retaining plate which, on release, allows the lock springs to release in turn ejecting the male plugs. This is a form of fail-safe operation which may be used primarily in high powered devices.

In FIG. 1 the retaining plate has been screwed down so as to compress the receptacle 6 so that the inner diameter of the coil springs is at a maximum. In this position, the female connector is unlocked. Now the male connector pins can be inserted into the female connector receptacles 6 without any friction because the outer diameter of the pins is smaller than the inner diameter of the receptacles in that position of the receptacles. Thereafter, the ring 10 is screwed out and the compression springs are permitted to relax performing a wiping action on the pins 16 and at the same time firmly surrounding the pins 16 with a positive holding action. The female connector is now locked.

The pin 20 in the threaded retaining ring is provided to prevent this ring from leaving the housing 9. As previously mentioned, the proper axial alignment is provided by the key 7.

Figure 2:
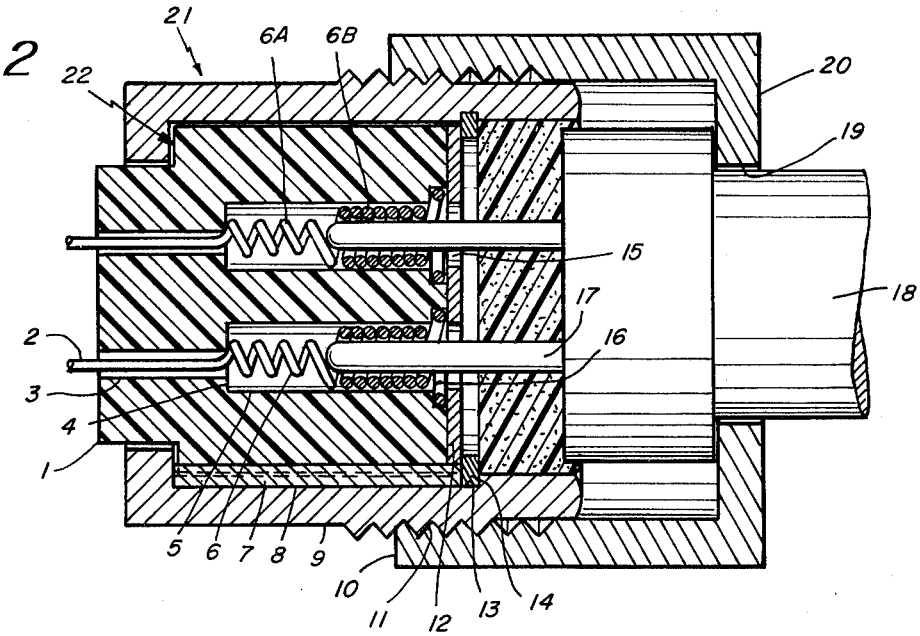
FIG. 2 is a cross-sectional view through a second embodiment of the invention also of a round assembled female connector.
Figure 3:
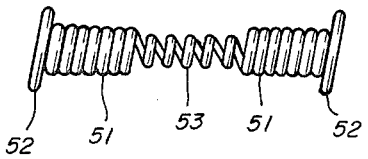
FIG. 3 is a view of an unrestrained receptacle wherein one or two connector pins may be engaged from each end to make a positive connection.

The connector shown in FIG. 2 is quite similar to the connector shown in FIG. 1. The connector of FIG. 2 comprises a housing 1 which is also made from an electrically insulated material having one or more bores 5 terminating in a counter bore 16. The male connector pins 17 enter the receptacles 6. In FIG. 3 many of the same reference characters describe similar portions of the connector as previously discussed with reference to FIG. 1.

In FIG. 2 the shell 9 has a groove 8 in which a portion of key 7 is located. The other portion of key 7 is located in a groove in the housing 1 and a groove in the retaining plate 12, both of which are enclosed in a shell 9 and restrain from movement by the shoulder 22 and the retaining ring 14. The retaining plate 12 is preferably also made from an electrically insulated material and has one or more apertures 15 for receiving the pins 17. The ring 10 has threads 11 and a shoulder 20 which fits in the smaller diameter of the male connector.

In the embodiment of FIG. 2 the connector receptacle 6 is made partially from a compression spring and partially from an extension spring. In FIG. 2 the compression spring is the portion of the coil shown of a smaller diameter. The receptacle 6 is enclosed in the bore 5 under unrestrained condition and is prevented from leaving the bore by the bottom end wall 4 which serves as a stop when axial force is applied. The receptacle 6 is also secured in place by the retaining disc 12 which has apertures 15 smaller in diameter than the outside diameter of the portion of the receptacle made from the extension spring. The disc 12 is held by retaining ring 13 located in grooves of housing 9. The pins of the male connector are engaged in the receptacle 6 with little or no friction. The inside diameter of the receptacle 6 are larger than the outside diameter of the male connector pins. By screwing in the threaded ring 10 into the housing 9, the tips of the male pins exert an axial pressure on the smaller diameter compression spring end of the receptacle 6 tending to compress that portion of that receptacle and at the same time expanding the extension spring of the receptacle, thereby providing a smaller diameter on the inside diameter which squeezes about the male connector pin to lock the arrangement. It can be seen from FIG. 2 that the male pin does not enter the section 6A of the spring and thus as the pin is inserted further, the tendency is to expand the section 6B thereby reducing this diameter and grasping the male pin.

Figure 9:
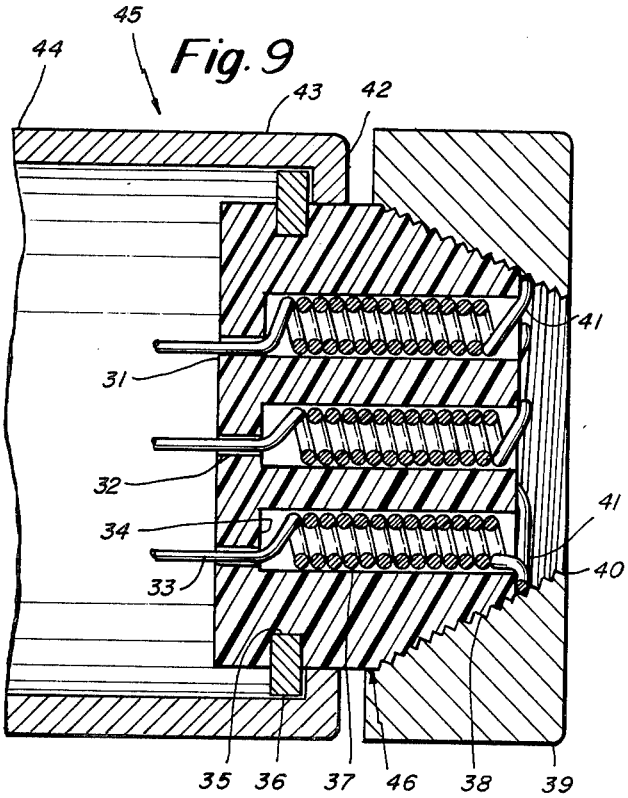
FIG. 9 is a cross-sectional view through still another embodiment of the invention using a round assembled female connector.
Figure 10:
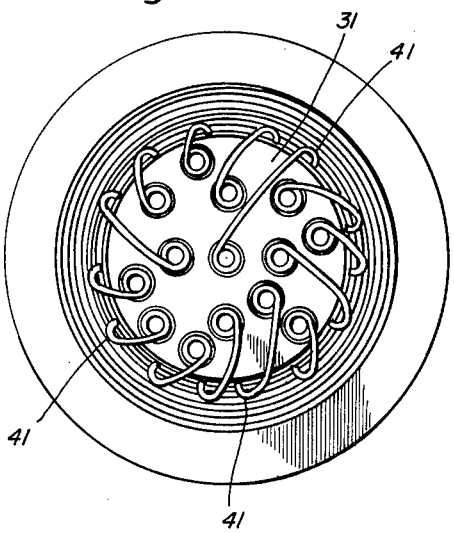
FIG. 10 is a side view of a portion of the connector shown in FIG. 9.

FIG. 9 shows still another embodiment of the present invention similar to the embodiment shown in FIGS. 1 and 2. FIG. 9 shows an assembled connector 45 which comprises a housing 31 preferably made from an electrically insulated material and having apertures 32 provided for passage of a portion of the receptacle 33 located in a bore 37 having a bottom wall 34 to secure the receptacle 33 in position. The housing also has a groove 35 for receiving a retaining ring 36 for holding the shell 43 by means of the flange 42. The housing 31 also has a pipe thread 38 allowing the locking ring 39, by its gradually decreasing diameter, to squeeze a portion of the torsion spring 41 which comprises the connectors receptacle. The other end 44 of the shell 43 may be finished by a circular, rectangular or other flange.

In FIG. 9 the principle of interconnection between the receptacles and pins is substantially the same as in the embodiments of FIGS. 1 and 2. The receptacles are made from compression, extension or torsion springs and are adapted to radially squeeze the inserted pin by its coils. However, in the case of the receptacles made from compression and extension springs, the wiping action and the squeezing process occurs by a diminishing of the inside diameter of the springs resulting indirectly by axial movement of the springs. On the other hand, when the springs are torsion springs, they squeeze and wipe the inserted object radially but directly with any axial movement of the torsion spring.

Thus, with regard to the embodiment of FIG. 9 there is provided a threaded locking ring 39 which is preferably made of an electrically insulated material and which can be encapsulated in a housing not depicted in FIG. 9. This ring 39 has threads 38 having a small diameter 40 and on the opposite end a larger diameter 46. The end 41 of the coil receptacle is made from a torsion spring having the extended end located in grooves of the threads 38. When the pins of a male connector (not shown) with a body slightly smaller in the outside diameter than the opening 40, is inserted, there is no friction within the receptacle 33 because the inside diameter of the receptacle in that position is larger than the outside diameter of the inserted pin. In that position the locking ring 39 is only slightly engaged in the threads of the female connector housing 31. By screwing in the locking ring 9 the threads of this ring exert a gradual pressure on the ends 41 of the receptacles thereby diminishing smoothly the inside diameter of the receptacles which are made from these torsion springs and, by this motion, the connector pins are wiped and squeezed providing a reliable connection between the male and female connector parts.

The above locking action of the female and male connectors described above refer to the receptacles as being in an unrestrained condition before the locking process commences. The squeezing of the probe then occurs by an axial displacement of the spring. Another way exists, however, and that is by holding the springs in a restrained condition, and thereafter once the pins have been inserted, providing a force to continue winding the springs so that the diameter of the springs decreases to squeeze the inserted object.

FIG. 3 shows a double-ended receptacle that may be employed in a housing such as the housing shown in FIGS. 1 and 2. However, with this arrangement the housing would be adapted to receive one or two pins or objects simultaneously each from one end of the extension springs 51. In the embodiment of FIG. 3 the ends 52 of the spring arrangement may be fastened to an immovable object. The pins that are to be inserted are of a size smaller than the inside diameter of the spring section 51 but having a larger diameter than the spring section 53. In this way when the pins are inserted, the compression spring section 53 is pushed in an axial direction toward its middle by axially compressing the spring section 53 at the same time elongating the extension springs 51 to reduce their diameter and radially wipe and squeeze the inserted pins.

Figure 4:
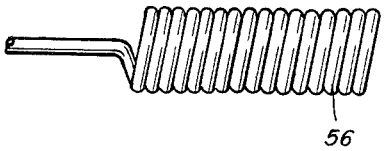
FIG. 4 shows a restrained female receptacle that may also receive two connector pins engaged from either end. The receptacle shown in FIG. 4 may also be of the type that is used in the embodiment of FIG. 1.

FIG. 4 shows a restrained compression spring receptacle 56 which can also accept one or two objects or pins simultaneously from each end. When the spring 56 is permitted to relax, the compression spring returns to its unrestrained position, at the same time wiping and squeezing the inserted pin.

Figure 5:
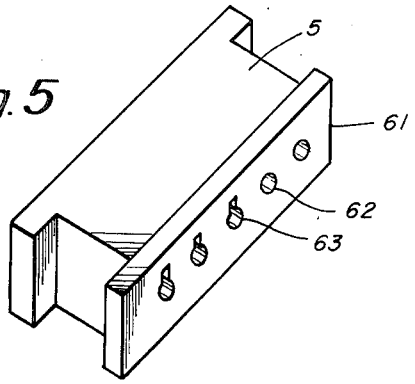
FIG. 5 is a perspective view of a rectangular connector that may use the same interconnecting principles shown in FIGS. 1 and 2.
Figure 8:
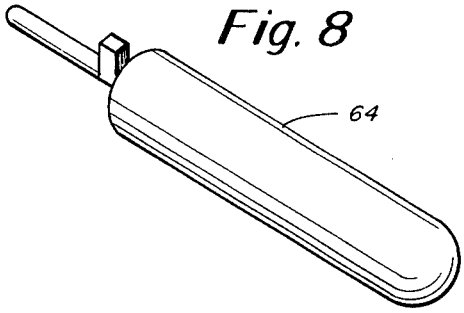
FIG. 8 is a male connector pin having a locking means associated therewith.

FIG. 5 shows a rectangular connector block 58 having a locking cover 61 which essentially functions the same as the locking rings shown in FIGS. 1 and 2 and which can be activated and locked by clamps not shown in FIG. 5. The round openings 62 shown in FIG. 5 are designed for round pins that are to be inserted. The openings 63 on the other hand are of a keyhole shape and adapted to accept pins such as the pin 64 shown in FIG. 8. When the pin is inserted, it may be turned slightly so that after this turning operation the pin is securely locked in the housing.

Figure 6:
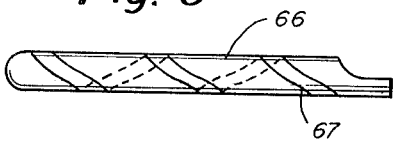
FIGS. 6 and 7 show different embodiments of a male connector pin in the form of a screw.
Figure 7:
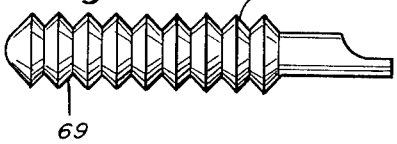

FIGS. 6 and 7 show still other arrangements of the male connector pins. The pin 66 shown in FIG. 6 has a groove 67 of a spiral configuration while the pin 68 shown in FIG. 7 has a series of grooves 69, each following a circular locus. The grooves 67 and 69 in FIGS. 6 and 7 may be utilized as a bearing surface for the separate coils of a receptacle so as to essentially provide a self-locking action once the pin has been inserted. The pins shown in FIGS. 6 and 7 may be used with the spring receptacle such as shown in FIG. 4 or FIGS. 1 and 2.

FIG. 11 shows a rectangular connector block 70 that utilizes the torsion concept of receptacle and has associated therewith a sliding locking cover 72. FIG. 11 also shows the ends 73 of the torsion springs such as the ends 41 previously described with reference to FIG. 9. The ends 73 function as levers for diminishing the inside diameter of the receptacles, thereby wiping and squeezing any inserted pins. By removing the locking cover 72 the inserted objects are unsqueezed and the entire connector is essentially unlocked. In this connection the cover 72 has a channel 74 for receiving the ends 73 and causing them to be operated to lock the receptacles.

FIG. 12 shows still another rectangular connector block 77 which utilizes the torsion concept receptacles of this invention. However, in this arrangement the wiping and squeezing process is accomplished individually by separate covers 79, each of which will individually engage with the ends 80 of the coil receptacle.

FIG. 13 shows another embodiment of a male connector pin 82 having grooves 83 that are used as bearing surfaces on the separate coils of a spring forming the receptacle. The pin 82 shown in FIG. 13 may be basically of cylindrical shape with the grooves extending circularly about the pin.

FIG. 14 is a perspective view showing a multi-wire male connector wherein one or more bare wires may be inserted in the aperture 91. These wires, once inserted are bent and disposed along the longitudinal grooves 92. These wires may stand above or below or be even with the crests 93. The grooves 92 are provided to hold the arranged wires or any other conductors or objects in position during the locking process. Thus, the bare wires may extend through the aperture 91 be bent into the grooves 92 and the entire pin may then be inserted into the housing containing the female receptacle. The through aperture 91 may have different inside diameters and the ends 94 of the pin is preferably threaded so as to provide an improved grip on the objects located inside. The threads 94 can also cover the entire pin and when screwed into a metal housing can form a solid screw making indentations in the inserted objects, and by this means providing a reliable connection.

From the foregoing description those skilled in the art will appreciate that numerous modifications may be made to this invention without departing from its spirit. Therefore, it is not intended that the breadth of this invention be limited to the specific embodiments illustrated and described herein, rather, it is intended that the breadth of the invention be determined by the appended claims and their equivalents.

What is claimed is:

1. An electrical connector comprising a female part including a housing having at least one bore therein, receptacle means comprising a coiled spring disposed in the bore of the housing and for receiving a male part having an outer dimension comparable to the inner dimension of the coiled spring, and means for engaging the spring to change the state thereof so that the inner diameter of the receptacle changes from one diameter to a lesser, locked-position diameter including a restraining means at one end of the housing facing the open bore and means for urging the restraining means against the spring to axially compress the spring to thereby increase its diameter so as to easily accommodate the male part.

2. An electrical connector as set forth in claim 1 wherein said means for engaging includes a restraining plate positioned at one of the housing facing the open bore and a locking ring coupled to the restraining plate for urging the restraining plate against the coil spring.

3. An electrical connector as set forth in claim 2 wherein said coil spring is restrained and compressed by the restraining plate when the connector is unlocked.

4. An electrical connector as set forth in claim 1 wherein said coil spring has sections of different diameter.

5. An electrical connector as set forth in claim 1 wherein said coil spring has an extending end and said means for engaging includes a locking ring having threads to receive the extending end.

6. An electrical connector comprising a female part having at least one hole extending through face in said part, a conductive receptacle comprising a helical spring having an uncompressed outer diameter which is spaced from the wall of said hole, means for compressing said spring positioned over said face and having an opening therein in alignment with said hole, said compressing means adapted to be moved relative to said housing for compressing said spring whereby the outer diameter of said spring is closer to said wall, and a small conductive pin having a diameter at least as great as the inner diameter of said spring when uncompressed and smaller than the inner diameter of said spring when compressed whereby said pin may be freely inserted in said helical spring when compressed and securely retained in firm electrical contact when said helical spring is uncompressed.

7. An electrical connector as set forth in claim 6 wherein said means for compressing moves axially of the helical spring axis.

8. An electrical connector as set forth in claim 7 wherein said means for compressing causes axial displacement of the helical spring.

9. An electrical connector as set forth in claim 8 wherein said helical spring has one end disposed within the female part hole and another end extending outwardly of the hole from the face of the female part and engageable by the means for compressing.

10. An electrical connector as set forth in claim 9 wherein said means for compressing has a hole corresponding to each female part hole.

11. An electrical connector as set forth in claim 6 wherein said male pin has grooves therein.

12. An electrical connector as set forth in claim 6 wherein said male pin is in the form of a screw.

13. An electrical connector as set forth in claim 6 including means for locking the male pin to the female part.

14. An electrical connector as set forth in claim 7 wherein said means for compressing includes a member mating with the female part and having internal threads for receiving an end of the helical spring that extends outwardly of the female part hole from the face of the female part.

15. An electrical connector as set forth in claim 14 wherein the member has tapered threads.

16. An electrical connector comprising a female part including a housing having at least one bore therein, receptacle means comprising a helical spring disposed in the bore of the housing and for receiving a male pin having an outer dimension comparable to the inner dimension of the helical spring, said helical spring including a receptacle section and control section, and means for engaging said control section of the spring to change the state thereof so that the inner diameter of the receptacle section changes from one diameter wherein the pin may be freely inserted to a smaller restrained diameter, said means for engaging including the male pin end engaging said control section.

17. An electrical connector as set forth in claim 16 wherein said spring receptacle section includes an extension spring section and said spring control section includes a compression spring section.

18. An electrical connector as set forth in claim 17 wherein said receptacle section has an inner diameter greater than the inner diameter of the control section.

19. An electrical connector as set forth in claim 18 wherein the male pin end engages the smaller diameter control section causing elongation of the receptacle section and attendant reduction of the receptacle section diameter to tightly squeeze the male pin.

20. An electrical connector as set forth in claim 16 including restraining means over the face of said housing and having at least one opening therein in alignment with the housing bore.

21. An electrical connector comprising a female part having at least one hole extending from a face of said part, a conductive receptacle comprising a helical spring having an outer diameter less than the female part hole diameter, said helical spring having a rest position wherein its inner diameter is at a maximum and a restraining position, a male conductive pin having a diameter on the order of the inner diameter of said spring in its rest position and greater than the inner diameter of said spring in its restraining position whereby said pin may be freely inserted in said helical spring when in the rest position and securely retained in firm electrical contact when said helical spring is moved to a restraining position, and means for positively engaging said spring positioned over the face of the housing and having an opening therein in alignment with the hole in the female part, said means for positively engaging the spring comprising means for rotating a free end of the spring, after having freely inserted the male pin, to cause the helical spring to securely tighten about the male pin.

22. An electrical connector as set forth in claim 21 wherein said means for engaging includes a member mating with the female part and having internal threads for receiving an end of the helical spring for rotation thereof.

23. An electrical connector as set forth in claim 22 wherein the member and female part have mating tapered threads.

* * * * *